US008545751B2

(12) United States Patent
Mills

(10) Patent No.: US 8,545,751 B2
(45) Date of Patent: Oct. 1, 2013

(54) REFRACTORY NOZZLE

(76) Inventor: Stephen David Mills, Middlesborough (GB)

( * ) Notice: Subject to any disclaimer, the term of this patent is extended or adjusted under 35 U.S.C. 154(b) by 438 days.

(21) Appl. No.: 12/307,344

(22) PCT Filed: Jun. 5, 2007

(86) PCT No.: PCT/GB2007/050318

§ 371 (c)(1),
(2), (4) Date: Nov. 13, 2009

(87) PCT Pub. No.: WO2008/003995

PCT Pub. Date: Jan. 10, 2008

(65) Prior Publication Data

US 2010/0059554 A1 Mar. 11, 2010

(30) Foreign Application Priority Data

Jul. 5, 2006 (GB) ..... 0613337.5

(51) Int. Cl.
*B22D 41/14* (2006.01)

(52) U.S. Cl.
USPC ..... 266/45; 222/590; 222/599; 222/600

(58) Field of Classification Search
USPC ..... 266/236, 45; 222/590, 599, 600, 222/601
See application file for complete search history.

(56) References Cited

U.S. PATENT DOCUMENTS

| | | | | |
|---|---|---|---|---|
| 4,385,715 | A | 5/1983 | Meier et al. | |
| 4,619,444 | A * | 10/1986 | Bachmann et al. | 266/236 |
| 5,154,875 | A * | 10/1992 | Luchs | 266/236 |
| 5,316,271 | A * | 5/1994 | Otsuka et al. | 266/236 |
| 5,690,854 | A * | 11/1997 | Bruckner et al. | 222/593 |
| 5,992,711 | A * | 11/1999 | Mochizuki et al. | 222/606 |

FOREIGN PATENT DOCUMENTS

| | | |
|---|---|---|
| EP | 0693339 | 1/1996 |
| GB | 2082303 | 3/1982 |
| GB | 2146100 | 4/1985 |
| GB | 2198979 | 6/1988 |
| JP | 01262061 | 10/1989 |

* cited by examiner

*Primary Examiner* — Scott Kastler
(74) *Attorney, Agent, or Firm* — Downs Rachlin Martin PLLC

(57) ABSTRACT

A refractory nozzle assembly comprising a vessel operable to contain a molten metal and having at least one outlet. The assembly includes an inner assembly having an aperture extending therethrough and an outer assembly having an aperture extending therethrough. The inner and outer assemblies are arranged in the outlet of the vessel and are arranged for relative lateral movement such that inner and outer assemblies are operable to move between an open configuration, where the apertures therethrough are generally overlapping, and a closed configuration, where the apertures are not overlapping. The junction between the inner and outer assemblies is located within a periphery of the vessel.

22 Claims, 4 Drawing Sheets

REFRACTORY NOZZLE

RELATED APPLICATION DATA

This application is a 371 of International Application No. PCT/GB2007/050318, filed Jun. 5, 2007, titled "A Refractory Nozzle," and further claims the benefit of priority of United Kingdom Patent Application No. 0613337.5, filed Jul. 5, 2006, which are incorporated by reference in their entirety.

FIELD OF THE INVENTION

The present invention relates to a refractory nozzle, particularly to a refractory nozzle, refractory nozzle assembly, a refractory nozzle kit and a method of installing replacing a refractory nozzle.

BACKGROUND

In foundries, devices such as bottom pour ladles, casting boxes and the like are used extensively to pour molten metal into moulds; these devices, which will hereinafter be referred to simply as ladles, are provided with a refractory nozzle in their bottom.

The flow of molten metal through the nozzle is known to be controlled in a number of ways. For example, it is known to have a refractory stopper in the interior of the ladle, the stopper being moveable with respect to the nozzle controlling the flow of metal. However, such a system has the problem, particularly in large ladles, that the stopper is long and cumbersome to adequately and accurately control.

An alternative system known in the art comprises a so called "slide gate". A slide gate compromises a unit that is added beneath the nozzle having two plates which each have an aperture therethrough and are arranged to slide over each other to control the flow of molten metal. However, this system has the problem that when the gate is closed and the flow of metal stopped, the metal between the nozzle and the slide gate almost instantaneously freezes, thus blocking the outlet. In order to unblock the outlet, the gate has to be lanced to melt the frozen metal and restart the pouring process. This is a dangerous, time consuming and expensive process.

Thus a need exists in the art to provide a means of controlling the flow of molten metal from a ladle that allows the flow to be interrupted and restarted without freezing and which avoids the cumbersome, difficult to control, refractory stopper.

SUMMARY OF THE DISCLOSURE

It is an aim of embodiments of the present invention to address the above mentioned or other problems.

According to a first aspect of the present invention there is provided a refractory nozzle assembly comprising:

a vessel operable to contain a molten metal and compromising at least one outlet;

an inner assembly having an aperture extending therethrough;

an outer assembly having an aperture extending therethrough;

the inner and outer assembly being arranged in the outlet of the vessel and being arranged for relative lateral movement such that the inner and outer assembly are operable to move between an open configuration, where the apertures therethrough are generally overlapping and a closed configuration, where the apertures are not overlapping;

wherein the junction between the inner and outer assembly is located within a periphery of the vessel.

Preferably, the vessel is a metallurgical vessel, such as a ladle or casting box, for example.

Preferably, the at least one outlet of the vessel is situated at or toward a bottom thereof.

Preferably, the inner and outer assembly are arranged to slide relative to each other. In one embodiment, the inner and outer assembly are arranged for relative rotation.

Preferably, the inner assembly comprises a first member, which preferably comprises a plate. Preferably, the outer assembly comprises a second member, which preferably comprises a plate.

Preferably, the inner assembly comprises a substantially planar face. Preferably, the outer assembly comprises a substantially planar face. Preferably the substantially planar faces of the inner and outer assemblies are arranged generally opposed each other, and preferably define the junction between the inner and outer assemblies.

Preferably, the first member comprises a substantially planar face. Preferably, the substantially planar face of the inner assembly is provided by the substantially planar face of the first member.

Preferably, the first member comprises a protrusion on a surface opposed to the substantially planar surface. Preferably, the protrusion surrounds the aperture that extends therethrough. Preferably, the protrusion is annular.

Preferably, the second member comprises a substantially planar face. Preferably, the substantially planar face of the outer assembly is provided by the substantially planar face of the second member.

Preferably, the second member comprises a protrusion on a surface opposed to the planar surface. Preferably, the protrusion surrounds the aperture that extends therethrough. Preferably, the protrusion is annular.

Preferably, the inner assembly further comprises an upper member, which is preferably operable to accommodate the first member. Preferably, the first member may be accommodated about a lower surface of the upper member, preferably in a shallow recess in the lower surface of the upper member. Preferably, the upper member is insertable into the outlet of the vessel. Preferably, the upper member is operable to be fixed to the vessel. Preferably, the upper member comprises an aperture therethrough. Preferably, in use, the upper member is located such that the aperture extends from an interior of the vessel to the first member. Preferably, the aperture of the upper member comprises a tapered bore, tapering from the interior of the vessel toward the first member. Preferably, a lower surface of the upper member comprises a deep recess section, which is preferably operable to accommodate the protrusion of the first member.

One of the many perceived advantages of the aforementioned assembly is that the provision of a protrusion and recess pair in the upper member and the first member reduces the risk of molten metal seeping out from the joint between the upper member and the first member, in use.

Preferably, the outer assembly further compromises a lower member, which is preferably operable to accommodate the second member. Preferably, the second member may be accommodated about the upper surface of the lower member, preferably in a shallow recess in the upper surface of the lower member.

Preferably, the outer assembly is insertable into the inner assembly.

Preferably, the lower member is insertable into an underside of the upper member. Preferably, the lower member comprises an aperture therethrough. Preferably, an upper surface of the lower member comprises a deep recess section, which is preferably operable to accommodate the protrusion of the second member.

One of the many perceived advantages of the aforementioned assembly is that the provision of a protrusion and recess pair in the lower member and the second member reduces the risk of molten metal seeping out from the joint between the lower member and the second member, in use.

Preferably, the second member is operable to be moved relative to the first member. Preferably, the second member is arranged to rotate relative to the first member.

Preferably, the relative lateral movement of the inner and outer assemblies is arranged to be controlled by control means. Preferably, the control means may be manually actuated. Preferably, the control means comprises a gearbox. Preferably, the gearbox is arranged to reduce the torque required to cause the relative lateral movement of the inner and outer assembly. Preferably, the gearbox is arranged to reduce the torque required to cause relative rotation of the inner and outer assembly.

Preferably, the control means is operable to control the movement of the outer assembly relative to the inner assembly. Preferably, the control means is operable to control rotation of the outer assembly relative to the inner assembly.

Preferably, the nozzle assembly further comprises a safety ring, which is preferably located around the junction of the inner assembly and the outer assembly. Preferably, the safety ring is located around the first member and the second member. The safety ring may be formed from any refractory material, such as graphite, for example.

Advantageously, the provision of a safety ring prevents, among other things, molten metal leaking from the junction between the inner assembly and the outer assembly, which can cause seizing of the inner assembly and the outer assembly and a significant health risk.

According to a further aspect of the present invention there is provided a refractory nozzle comprising an inner assembly and an outer assembly, the inner assembly being operable to be received in an outlet of a metallurgical vessel and the outer assembly being operable to be received in an underside of the inner assembly; wherein the junction between the inner assembly and the outer assembly is located at a point within the inner assembly such that it is within a periphery of the metallurgical vessel, in use.

Preferably, the inner assembly and the outer assembly are arranged for relative lateral movement. Preferably, the inner assembly and the outer assembly are arranged for relative rotation.

Preferably, the inner assembly has tapered outer walls, such that it is preferably operable to act like a bung in the outlet of the metallurgical vessel, in use. Preferably, the size and taper of the outer walls of the inner assembly are chosen such that the junction between the inner assembly and the outer assembly is located at a point within the inner assembly, such that it is preferably within a periphery of the metallurgical vessel, in use.

Preferably, the inner assembly comprises an aperture extending therethrough. Preferably, the outer assembly comprises an aperture extending therethrough.

Preferably, the inner assembly and the outer assembly are arranged for relative lateral movement between an open configuration, where the apertures therethrough are generally overlapping and a closed configuration where the apertures therethrough are not overlapping.

According to a further aspect of the present invention there is provided a refractory nozzle kit comprising an inner assembly and an outer assembly, wherein the inner assembly is operable to be received in an outlet of a metallurgical vessel, and the outer assembly is operable to be received in an underside of the inner assembly; wherein the inner assembly has tapered outer walls, such that it is operable to form a bung in an outlet of a metallurgical vessel, in use, and wherein the size and taper of the outer walls of the inner assembly are chosen such that the junction between the inner assembly and the outer assembly is located at a point within the inner assembly such that it is within a periphery of the metallurgical vessel, in use.

Preferably, the inner assembly comprises an aperture extending therethrough. Preferably, the outer assembly comprises an aperture extending therethrough.

According to a further aspect of the present invention there is provided a first member suitable for use with an inner assembly of the refractory nozzle, refractory nozzle assembly or refractory nozzle kit of the above aspects of invention.

According to a further aspect of the present invention there is provided a second member suitable for use with an outer assembly of the refractory nozzle, refractory nozzle assembly or refractory nozzle kit of the above aspects of invention.

According to a further aspect of the present invention there is provided a method of installing a refractory nozzle comprising; securing an inner assembly into an outlet of a metallurgical vessel, securing an outer assembly to the inner assembly and arranging the inner assembly and the outer assembly for relative lateral movement, wherein the junction between the inner assembly and the outer assembly is located within a periphery of the metallurgical vessel.

Preferably, the method also comprises adding a safety ring around the junction between the inner assembly and the outer assembly, which safety ring is preferably formed of a refractory material, such as graphite, for example.

An aspect of the invention relates to the control of molten metal via a ladle, the device allows full control of the molten metal stream to be completely stopped and started numerous times without a time limit on freezing. This is not a "sliding gate" system, it is a two piece refractory nozzle which rotates to align an offset hole which allows molten metal to flow therethrough. The outer nozzle is situated in the refractory lining and sits proud of the ladle base, ensuring that the outer nozzle is immersed in molten metal. The inner nozzle fits into the outer nozzle and rotates via a chain driven mechanical system. The inner and outer are tensioned together via gas springs, which expand during use and ensure that the molten metal cannot pass between them. The inner and outer refractory parts have additional refractory pieces, that can be changed to accommodate for refractory wear this can also accommodate different nozzle aperture sizes.

All of the features contained herein may be combined with any of the above aspects and in any combination.

BRIEF DESCRIPTION OF THE DRAWINGS

For a better understanding of the invention, and to show how embodiments of the same may be carried into effect, reference will now be made, by way of example, to the accompanying diagrammatic drawings in which.

DETAILED DESCRIPTION

Figure 1:
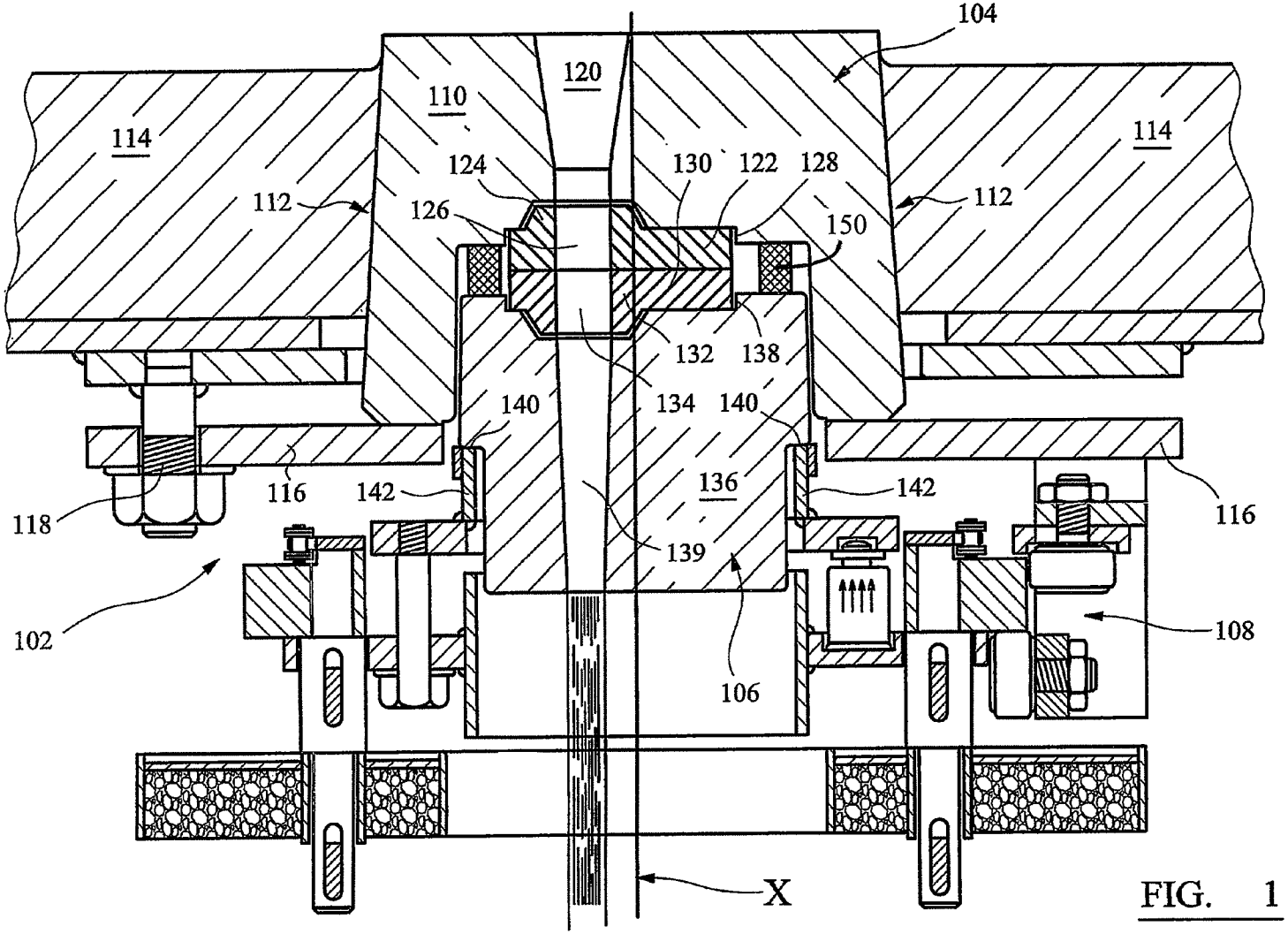
FIG. 1 shows a schematic sectional view of an exemplary refractory nozzle assembly in accordance with certain aspects of the present invention.

Referring to FIG. 1 there is shown an exemplary refractory nozzle assembly 102 comprising an inner nozzle assembly 104, an outer nozzle assembly 106 and a control mechanism 108.

The inner nozzle assembly 104 comprises an upper member 110 having tapered outer walls and being closely accommodated in an outlet 112 of a metallurgical vessel 114. The upper member 110 is held in place relative to the vessel 114 by a flange plate 116 which is secured to the vessel's underside with nuts/bolts 118 (only one set of nut/bolt shown for clarity). The upper member 110 comprises an aperture 120 extending therethrough from an interior of the vessel 114 to an underside of the member 110. The inner nozzle assembly 104 further comprises a first member 122 located on an underside of the upper member 110.

The first member 122 has a frusto-conical annular protrusion 124 extending from an upper face thereof which surrounds a circular aperture 126 that extends through the first member 122. The protrusion 124 is accommodated in a similar shaped and sized recess in an underside of the upper member 110. The first member 122 is accommodated within a shallow recess 128 in the underside of the upper member 110. The first member 122 has a flat lower face that abuts a flat opposed upper face of a second member 130.

The outer nozzle assembly 106 comprises a lower member 136 and a second member 130. The second member 130 has a frusto-conical annular protrusion 132 extending from a lower surface thereof, similar to that of the upper surface of the first member 110, which protrusion also surrounds a circular aperture 134 that extends through the second member 130. The second member 130 is accommodated on an upper surface of a lower member 136.

The lower member 136 comprises a shallow recess 138 on an upper surface thereof, which recess 138 accommodates the second member 130. The upper surface of the lower member also comprises a deep recess section to closely accommodate the protrusion 132 of the second member. The lower member 136 has an aperture 139 that extends therethrough from an upper surface thereof to a lower surface thereof. The lower member 136 also comprises a circumferential rib section 140 on its outer walls upon which sits a support ring 142, which support ring 142 pushes the lower member 136 upwards toward the upper member 110, thus forcing the opposing planar faces of the first member 122 and the second member 130 together. In this manner, the junction between the inner assembly and the outer assembly is held under pressure. The support ring 142 is part of the control mechanism 108. As mentioned above in the Summary of the Disclosure section, a safety ring 143 is provided around the junction between the inner assembly and the outer assembly, which is generally at the interface of the first and second members 122, 130.

Both the first member 122 and the second member 130 are formed from a refractory material. Thus, the nozzle operates on a sliding movement between refractory plate to refractory plate, rather than a metal banded casing.

The control mechanism 108 comprises a cradle 144 to support the lower member 136. The cradle comprises a tension ring 146 and a number of wedge holes 148. In use, a user inserts wedge shaped inserts into the wedge holes 148 to thereby force the upper member 110 and lower member 136 together. The control mechanism also comprises a gearbox (not shown) to reduce the torque required to rotate the outer assembly 106 relative to the inner assembly 104 (described below).

In use, one embodiment of refractory nozzle assembly 102 operates as follows. The nozzle is moved to a closed configuration in which the apertures 120 and 126 of the inner assembly 104 do not overlap with the apertures 134 and 139 of the outer assembly 106. This is achieved by rotation of the lower member 136 and second member 130 about axis "X" as shown in FIG. 1. This rotation causes the apertures to become misaligned, because the apertures are eccentric with regard to the axis of rotation "X". The metallurgical vessel is then filled with molten metal and maneuvered to a place where the molten metal is to be poured. The nozzle is then opened, by rotating the outer assembly 106 relative to the inner assembly 104 until the apertures extending therethrough overlap, thus allowing molten metal to flow from inside the vessel 114 through the apertures 120, 126, 134, 139 and out of the nozzle.

The nozzle may then be closed by rotation of the outer assembly 106 relative to the inner assembly 104 until the apertures therethrough are not overlapping.

This opening and closing procedure may be repeated many times with a single batch of molten metal because the junction between the first member and the second member is located within the periphery of the metallurgical vessel i.e., it is above the bottom of the vessel 114 as shown in FIG. 1.

Figure 2A:
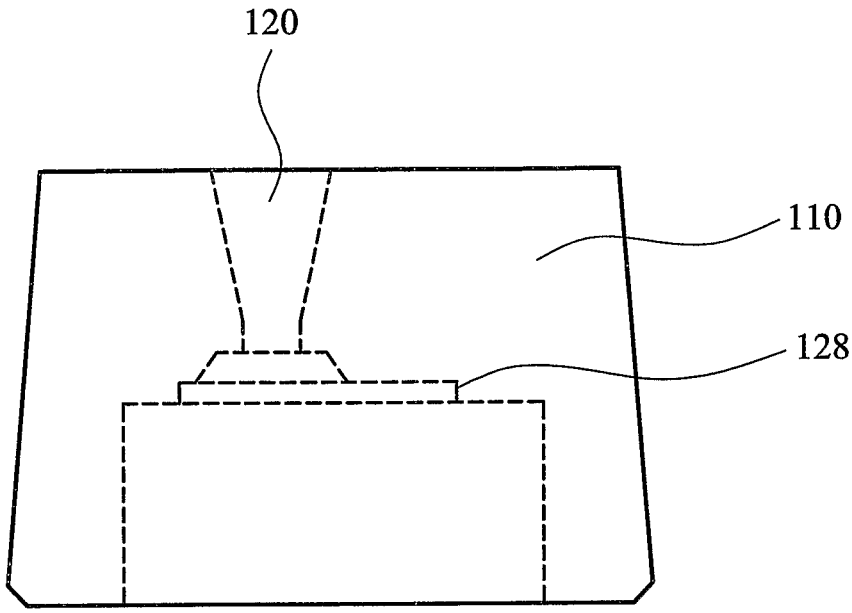
FIG. 2*a* shows a cross sectional view of an upper member of an exemplary refractory nozzle in accordance with certain aspects of the present invention.
Figure 2B:
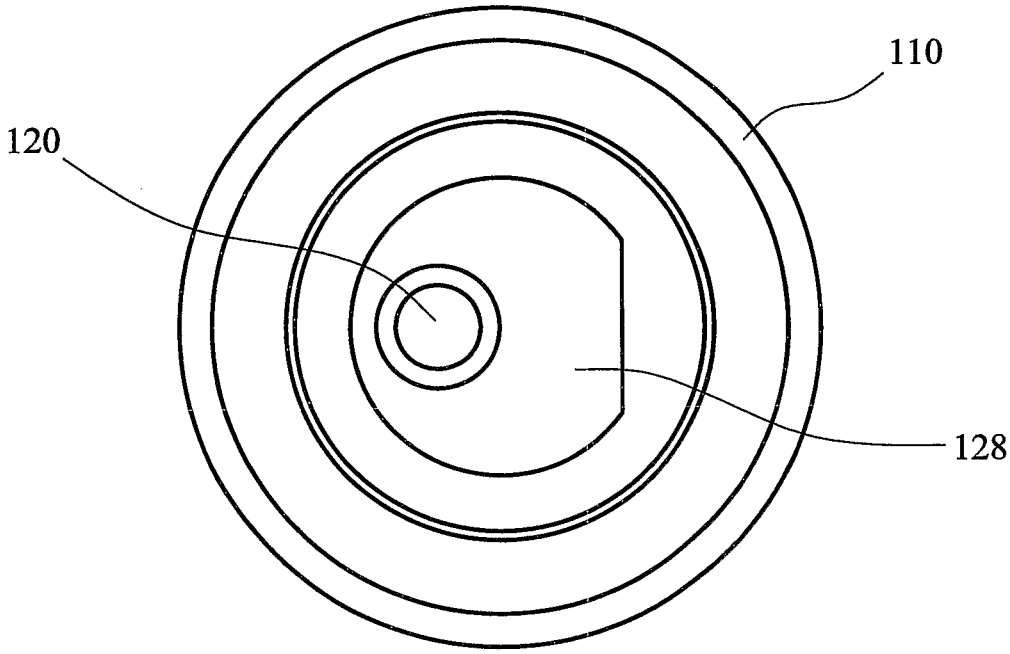
FIG. 2*b* shows a view from an underside of the upper member illustrated in FIG. 2*a;*

Referring now to FIGS. 2*a* and 2*b*, there is shown an exemplary upper member 110 without the first member 122 attached thereto. Of particular interest is the shape of the shallow recess 128 which accommodates the first member 122 in use. As is shown in FIG. 2*b*, the recess 128 is circular with a flat edge. This shape corresponds to the outer shape of the first member 122, the flat edge serving to correctly locate the first member 122 within the upper member 110, in use. Also clearly shown is that the aperture 120 is eccentric with regard to the circular outer body of the upper member 110.

The refractory nozzle assembly 102 further comprises a safety ring 150, which can be located around the junction of the inner nozzle assembly 104 and the outer nozzle assembly 106. In the illustrated embodiment, the safety ring 150 is located around the first member 122 and the second member 130. The safety ring can be formed from any refractory material, such as graphite, for example. Advantageously, the provision of a safety ring prevents, among other things, molten metal leaking from the junction between the inner nozzle assembly 104 and the outer nozzle assembly 106, which can cause seizing of the inner nozzle assembly 104 and the outer nozzle assembly 106 and cause a significant health risk.

Figure 3A:
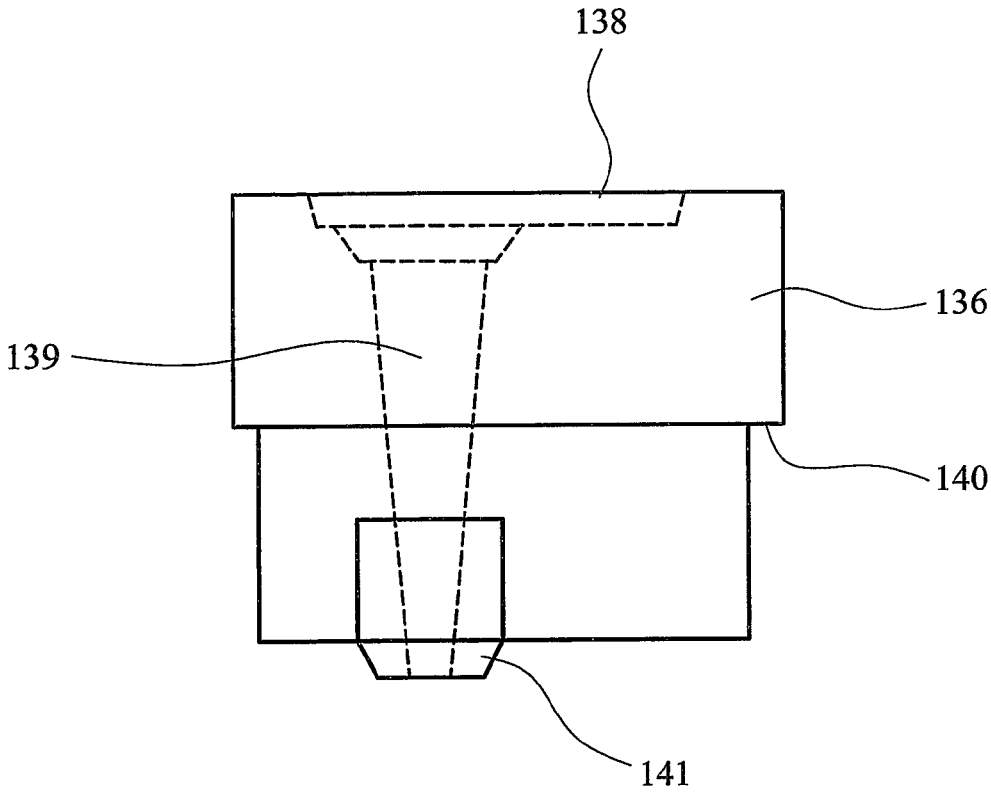
FIG. 3*a* shows a cross sectional view of a lower member of an exemplary refractory nozzle in accordance with certain aspects of the present invention.
Figure 3B:
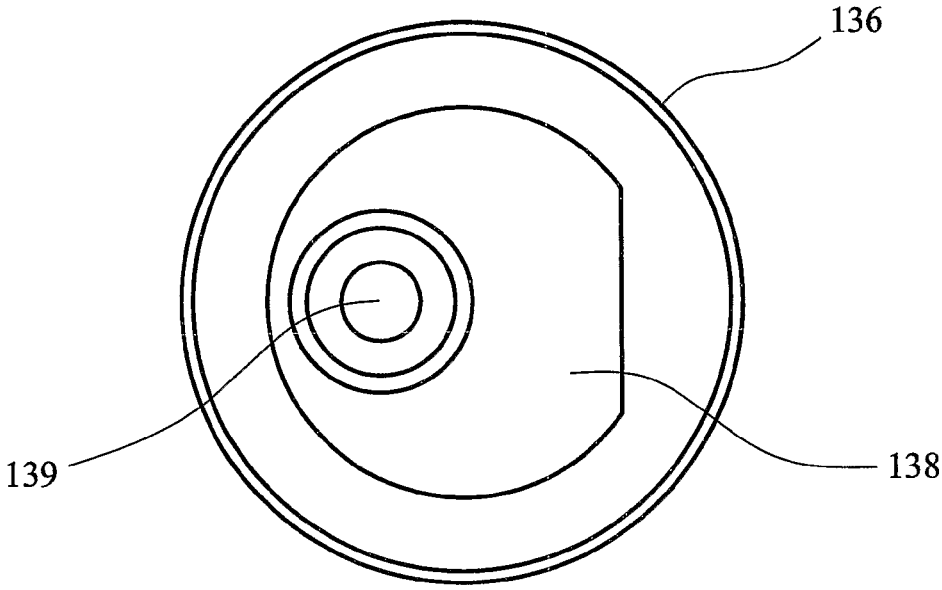
FIG. 3*b* shows a plan view of the exemplary refractory nozzle illustrated in FIG. 3*a*.

Referring now to FIGS. 3*a* and 3*b* there is shown an exemplary lower member 136 without the second member 130 attached thereto. As discussed above with regard to FIGS. 2*a* and 2*b*, the figures show that the shallow recess 138 is generally circular, but has a flat edge which serves to locate and correctly align the second member 130 in the recess 138 of the lower member 136. The lower member 136 shown in FIG. 3*a* also comprises a tapered bore 139, tapering toward an outlet end of the aperture 139. Also, toward the outlet end of the aperture 139 (ie. distal to the recess 138) is a replaceable outlet unit 141. In use, this is a high wear area, thus the outlet unit 141 is cemented into the lower member 136 and is easily replaceable, without the need to replace the entire lower member. As shown, the outlet unit 141 comprises an aperture that corresponds to the aperture 139 and in use forms a seamless outlet.

It will be appreciated by one skilled in the art that the aperture 139 in the lower member 136 may be straight or tapered and may have differing bores. A user may select a bore that is suitable for the particular requirements of the nozzle.

Figure 4:
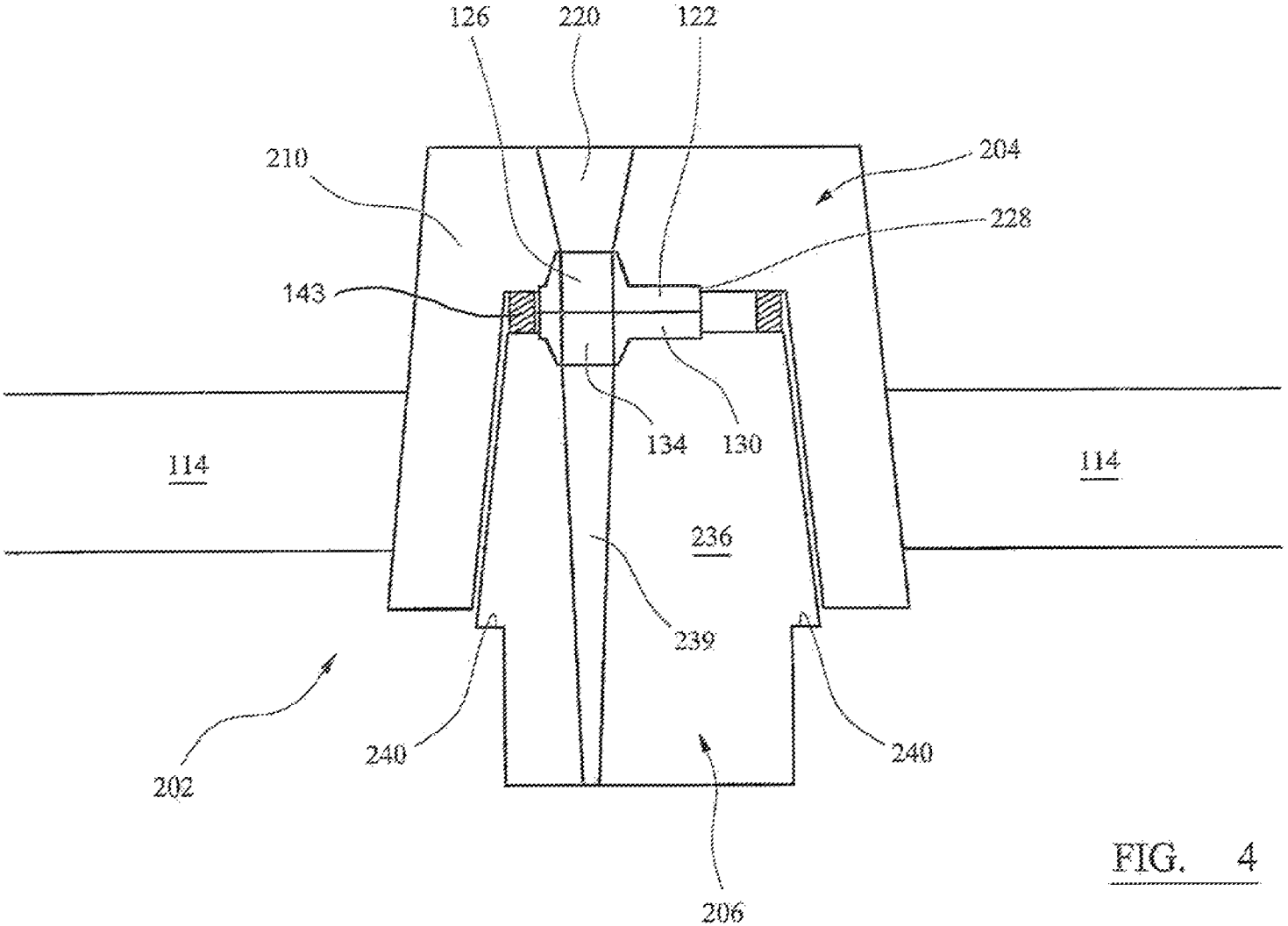
FIG. 4 shows a schematic sectional view of another embodiment of a refractory nozzle assembly.

Referring to FIG. 4 there is shown an alternative embodiment of a refractory nozzle assembly 202. The assembly 202 comprises an inner nozzle assembly 204 and an outer nozzle assembly 206. To aid the clarity of FIG. 4 and to make it readily understandable by one skilled in the art, similar parts in the assembly to that described above have been given similar numbers, but prefixed with the number 2 rather than 1. Parts which are the same as those described in the previous figures retain their original numbers (such as the vessel and the first and second members etc.). For clarity, many parts of the assembly 202 have been omitted from FIG. 4 (such as the control means etc.). If parts are omitted, then they should be considered as being generally the same as those described above with reference to FIG. 1.

The assembly 202 is similar and functions in the same way as that described above in relation to FIG. 1. However, the outer nozzle assembly 206 is accommodated deeper within the inner nozzle assembly 204, thus the junction between the two assemblies 204 and 206 is located deeper within the vessel 114. In such an embodiment, the junction between the inner nozzle and the outer nozzle is within the metallurgical vessel and surrounded by molten metal in use, thus the temperature of the junction is maintained at an elevated level, thus further decreasing the likelihood that the metal in the apertures 220 and 126 will freeze when the nozzle is moved into a closed position (by rotation of the outer nozzle assembly 206 relative to the inner nozzle assembly 204).

An embodiment of the refractory nozzle and assembly made in accordance with certain aspects of the present invention has a junction of the laterally moveable plates within the periphery of the metallurgical vessel. This offers the advantage that the nozzle is easy to control, but can also be closed and re-opened without the molten metal in the nozzle instantly freezing. The provision of a rotating nozzle and gearbox allows a user to manually control the nozzle with ease and accuracy.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A refractory nozzle assembly comprising:

a vessel operable to contain a molten metal and comprising at least one outlet;

an inner assembly having an aperture extending therethrough;

an outer assembly having an aperture extending therethrough;

the inner and outer assembly being arranged in the outlet of the vessel and being arranged for relative lateral movement such that the inner and outer assembly are operable to move between an open configuration, where the apertures therethrough are generally overlapping and a closed configuration, where the apertures are not overlapping; and wherein a junction between the inner and outer assembly is located within a periphery of the vessel;

wherein the refractory nozzle assembly comprises a safety ring positioned around the junction of the inner assembly and the outer assembly, the safety ring being configured to prevent molten metal from leaking from the junction of the inner assembly and the outer assembly.

2. A refractory nozzle comprising an inner assembly and an outer assembly, the inner assembly being operable to be received in an outlet of a metallurgical vessel and the outer assembly being operable to be received in an underside of the inner assembly, the inner assembly and the outer assembly being configured for relative lateral movement; wherein the junction between the inner assembly and the outer assembly is located at a point within the inner assembly such that it is within a periphery of the metallurgical vessel, in use; and wherein the refractory nozzle assembly comprises a safety ring positioned around the junction of the inner assembly and the outer assembly, the safety ring being configured to prevent molten metal from leaking from the junction of the inner assembly and the outer assembly.

3. A refractory nozzle according to claim 2, wherein the inner assembly and the outer assembly are arranged for relative lateral movement.

4. A refractory nozzle according to claim 2, wherein the inner and outer assembly are arranged for relative rotation.

5. A refractory nozzle assembly according to claim 1, wherein the inner assembly comprises a substantially planar face and the outer assembly comprises a substantially planar face; wherein the substantially planar faces of the inner and outer assemblies are arranged generally opposed each other, and define the junction between the inner and outer assemblies.

6. A refractory nozzle assembly according to claim 5, wherein the inner assembly comprises a first member, which comprises the substantially planar face.

7. A refractory nozzle assembly according to claim 6, wherein the first member comprises a protrusion on a surface opposed to the substantially planar surface, which protrusion surrounds an aperture that extends through the first member.

8. A refractory nozzle assembly according to claim 5, wherein the outer assembly comprises a second member which comprises the substantially planar surface.

9. A refractory nozzle assembly according to claim 8, wherein the second member comprises a protrusion on a surface opposed to the planar surface, which protrusion surrounds an aperture that extends through the second member.

10. A refractory nozzle assembly according to claim 6, wherein the inner assembly further comprises an upper member, which is operable to accommodate the first member.

11. A refractory nozzle assembly according to claim 10, wherein the first member is accommodated in a recess in a lower surface of the upper member.

12. A refractory nozzle assembly according to claim 11, wherein the upper member is insertable into the outlet of the vessel.

13. A refractory nozzle assembly according to claim 10, wherein the upper member is operable to be fixed to the vessel.

14. A refractory nozzle assembly according to claim 8, wherein the outer assembly further compromises a lower member, which is operable to accommodate the second member.

15. A refractory nozzle assembly according to claim 14, wherein the second member is accommodated in a shallow recess in an upper surface of the lower member.

16. A refractory nozzle assembly according to claim 1, wherein the outer assembly is insertable into the inner assembly.

17. A refractory nozzle according to claim 2, wherein the inner assembly has tapered outer walls, such that it is operable to act like a bung in the outlet of the metallurgical vessel, in use.

18. A refractory nozzle kit comprising an inner assembly and an outer assembly, wherein the inner assembly is operable to be received in an outlet of a metallurgical vessel, and the outer assembly is operable to be received in an underside of the inner assembly; wherein the inner assembly has tapered outer walls, such that it is operable to form a bung in an outlet of a metallurgical vessel, in use, and wherein the size and taper of the outer walls of the inner assembly are chosen such that the junction between the inner assembly and the outer assembly is located at a point within the inner assembly such that it is within a periphery of the metallurgical vessel, in use; and wherein the refractory nozzle kit further comprises a safety ring designed and configured to extend around the junction of the inner assembly and the outer assembly, the safety ring being configured to prevent molten metal from leaking from the junction of the inner assembly and the outer assembly in use.

19. A method of installing a refractory nozzle comprising: securing an inner assembly into an outlet of a metallurgical vessel, securing an outer assembly to the inner assembly and arranging the inner assembly and the outer assembly for relative lateral movement, wherein the junction between the inner assembly and the outer assembly is located within a periphery of the metallurgical vessel, wherein the method comprises arranging a safety ring around the junction of the inner assembly and the outer assembly, the safety ring being configured to prevent molten metal from leaking from the junction of the inner assembly and the outer assembly.

20. A refractory nozzle according to claim 1, wherein one of the inner assembly and the outer assembly are configured to rotate about a longitudinal axis, and wherein the apertures are eccentric to the longitudinal axis such that rotation of the inner assembly or outer assembly about the longitudinal axis causes the apertures to move between the open configuration and the closed configuration.

21. A refractory nozzle according to claim 1, wherein the inner assembly further comprises an upper member having a lower surface and a first member extending from the lower surface of the upper member, and the outer assembly further comprises a lower member having an upper surface and a second member extending from the upper surface of the lower member, the first member and the second member being positioned adjacent to each other and defining the junction between the inner assembly and outer assembly, wherein the safety ring extends between the upper member lower surface and the outer member upper surface and surrounds the first member and the second member.

22. A refractory nozzle according to claim 1, further comprising a gap between the inner assembly and the outer assembly, the safety ring being configured and dimensioned to be positioned in the gap such that an upper portion of the safety ring abuts a lower surface of the inner assembly and a lower portion of the safety ring abuts an upper surface of the outer assembly.

* * * * *